US008196554B2

(12) United States Patent
Amano et al.

(10) Patent No.: US 8,196,554 B2
(45) Date of Patent: Jun. 12, 2012

(54) SACRIFICIAL ELECTRODE MOUNTING STRUCTURE

(75) Inventors: Akira Amano, Wako (JP); Wataru Shimazaki, Wako (JP); Hiroshi Watanabe, Wako (JP); Yutaka Kubota, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 319 days.

(21) Appl. No.: 12/700,203

(22) Filed: Feb. 4, 2010

(65) Prior Publication Data

US 2010/0251978 A1 Oct. 7, 2010

(30) Foreign Application Priority Data

Apr. 6, 2009 (JP) ..... P2009-092341

(51) Int. Cl.
*F01P 5/14* (2006.01)

(52) U.S. Cl. ..... 123/41.15; 123/41.01; 123/198 E

(58) Field of Classification Search ..... 123/41.01, 123/41.15, 198 E; 440/88 C, 88 D, 88 G, 440/88 J, 88 M, 89 C; 204/196.3, 196.31
See application file for complete search history.

(56) References Cited

U.S. PATENT DOCUMENTS

| | | | | | |
|---|---|---|---|---|---|
| 3,355,370 | A | * | 11/1967 | Baker, Jr. | 205/738 |
| 4,615,684 | A | * | 10/1986 | Kojima | 440/88 R |
| 5,524,584 | A | * | 6/1996 | Wantanabe | 123/184.38 |
| 6,083,064 | A | * | 7/2000 | Watanabe et al. | 440/88 R |
| 6,142,109 | A | * | 11/2000 | Fukuda et al. | 123/41.15 |
| 6,319,090 | B1 | * | 11/2001 | Gross | 446/487 |

FOREIGN PATENT DOCUMENTS

JP 10-236390 A 9/1998

* cited by examiner

*Primary Examiner* — Noah Kamen
*Assistant Examiner* — Hung Q Nguyen
(74) *Attorney, Agent, or Firm* — Arent Fox LLP

(57) ABSTRACT

Mounting port, provided adjacent to a cooling water passageway, has a hole opening from the passageway for mounting an anode metal in the passageway. Lid member, which closes the outer end of the hole, has a head portion formed at its outer end and an externally threaded portion engageable with an internally threaded portion of the hole with a sealing member sandwiched therebetween. The lid member having the anode metal fixed thereto is inserted in and attached to the port with the threaded portions engaging with each other with a sealing tape sandwiched therebetween. Space is defined between an outer end portion of the port and an outer end portion of the lid member between the head portion and the externally threaded portion so that part of the sealing member protruding from between the threaded portions can be received in the space.

2 Claims, 5 Drawing Sheets

SACRIFICIAL ELECTRODE MOUNTING STRUCTURE

FIELD OF THE INVENTION

The present invention relates to an improvement in sacrificial electrode mounting structures.

BACKGROUND OF THE INVENTION

In outboard engine units, various metal portions are exposed to seawater, and thus, metal members more prone to corrosion than the metal portions are sometimes attached to the metal portions with a view to preventing corrosion of the metal portions. The "metal members more prone to corrosion" are often called "sacrificial electrodes" or "sacrificial anodes" because they are more easily ionizable and have a lower positive potential than the metal portions and dissolve due to corrosion in place of the metal portions. Examples of the conventionally-known mounting structures for such a sacrificial electrode include one where a mounting port with a mounting hole opening to a water jacket of a cylinder head is closed with a cover, and where a sacrificial electrode is attached to the cover (see, for example, Japanese Patent Application Laid-Open Publication No. H10-236390).

FIGS. 4 and 5 show the sacrificial electrode mounting structure disclosed in the H10-236390 publication. As shown, the water jacket 102 is provided in the cylinder head 101, and circular holes 103 and 104 are formed in the cylinder head 101 in such a manner that the holes 103 and 104 open to the water jacket 102. An anode 107 functioning as the sacrificial electrode is inserted in the water jacket 102 and fixedly fastened, via a bolt 108, to the cover 106 that closes the circular holes 103 and 104 and is fixedly mounted to the cylinder head 101 by means of a bolt 111. However, because the cover 106 has a large mounting area, it sometimes can not be properly mounted in a small space of the cylinder head 101.

In order to prevent the aforementioned special problem, a sacrificial electrode mounting structure shown in FIG. 6 has been proposed, in which a lid member 118 is screwed to a mounting port 117 that opens to a water jacket 116 of an engine 115 and in which an anode metal member 122 functioning as a sacrificial electrode is fixedly fastened, via a screw 121, to a distal end portion of the lid member 118. However, because the lid member 118 is screwed to the mounting port 117 with a sealing tape wound on an external thread of the lid member 118 in order to seal an engagement portion between an internally threaded portion of the mounting port 117 and the externally threaded portion of the lid member 118, part of the sealing tape may sometimes undesirably protrude outside the engagement portion to get into between a flange 118*a* of the lid member 118 and a washer 123 or between the washer 123 and an end surface 117*a* of the mounting port 117. As a consequence, an electrical connection between the mounting port 117 and the lid member 118 (more specifically, the anode metal member 122 fixed to the lid member 118) tends to become poor, which may result in contact failure of the sacrificial electrode (i.e., anode metal member 122). Thus, it would become difficult for the anode metal member 122 to corrode because electric corrosion of the anode metal member 122 is hindered.

SUMMARY OF THE INVENTION

In view of the foregoing prior art problems, it is an object of the present invention to provide an improved sacrificial electrode mounting structure which can reliably prevent contact failure of a sacrificial electrode.

In order to accomplish the above-mentioned object, the present invention provides an improved sacrificial electrode mounting structure for mounting a sacrificial electrode in a cooling water passageway provided in a cylinder block of a water-cooled engine of an outboard engine unit, which comprises: a mounting port provided adjacent to the cooling water passageway and having a mounting hole opening from the cooling water passageway for mounting the sacrificial electrode in the cooling water passageway: and a lid member closing the outer end of the mounting hole remote from the cooling water passageway, the lid member having a head portion formed at the outer end thereof and an externally threaded portion extending from near the head portion, the lid member having the sacrificial electrode fixedly fastened thereto being inserted in the mounting hole and attached to the mounting port with the externally threaded portion engaging with an internally threaded portion formed in the mounting hole of the mounting port with a sealing member sandwiched therebetween, With the lid member fixedly attached to the mounting port, a space is defined between an outer end portion of the mounting port located outwardly of the internally threaded portion and an outer end portion of the lid member between the externally threaded portion and the head portion, so that part of the sealing member protruding from between the externally threaded portion and the internally threaded portion engaging with each other can be received in the space.

With the lid member, having the sacrificial electrode fixedly fastened thereto, inserted in the mounting hole of the mounting port and duly attached to the mounting port with the externally threaded portion of the lid member and the internally threaded portion of the mounting port engaging with each other with the sealing tape sandwiched therebetween, the space is defined between the outer end portions of the mounting port and the lid member. Thus, the present invention not only allows the sacrificial electrode to be easily replaced as necessary by merely removing or detaching the lid member from the mounting port, but also can reliably prevent contact failure between the mounting port and the lid member which would occur due to the provision of the sealing member between threaded portions and thus can promote corrosion of the sacrificial electrode by securing a good electrical connection between the sacrificial electrode and the mounting port.

The space may be defined by at least one of an annular recessed portion formed in the lid member between the head portion and the externally threaded portion, and an annular recessed portion formed in the inner peripheral surface of the mounting port.

Because the space can be defined by the annular recessed portion formed in the outer peripheral surface of the lid member, the space can be formed easily by merely forming the annular recessed portion in the lid member. Also, because the space can be defined by the annular recessed portion formed in the inner peripheral surface of the outer end portion of the mounting port, the present invention can minimize the number of necessary steps for making a setup change of a device employed for forming the mounting port, by forming the annular recessed portion in the mounting port large-diameter hole as well at the time of the formation of the mounting port.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

In the following description, the terms "front", "rear", "left" and "right" are used to refer to directions as viewed from a human operator aboard a boat.

Figure 1:
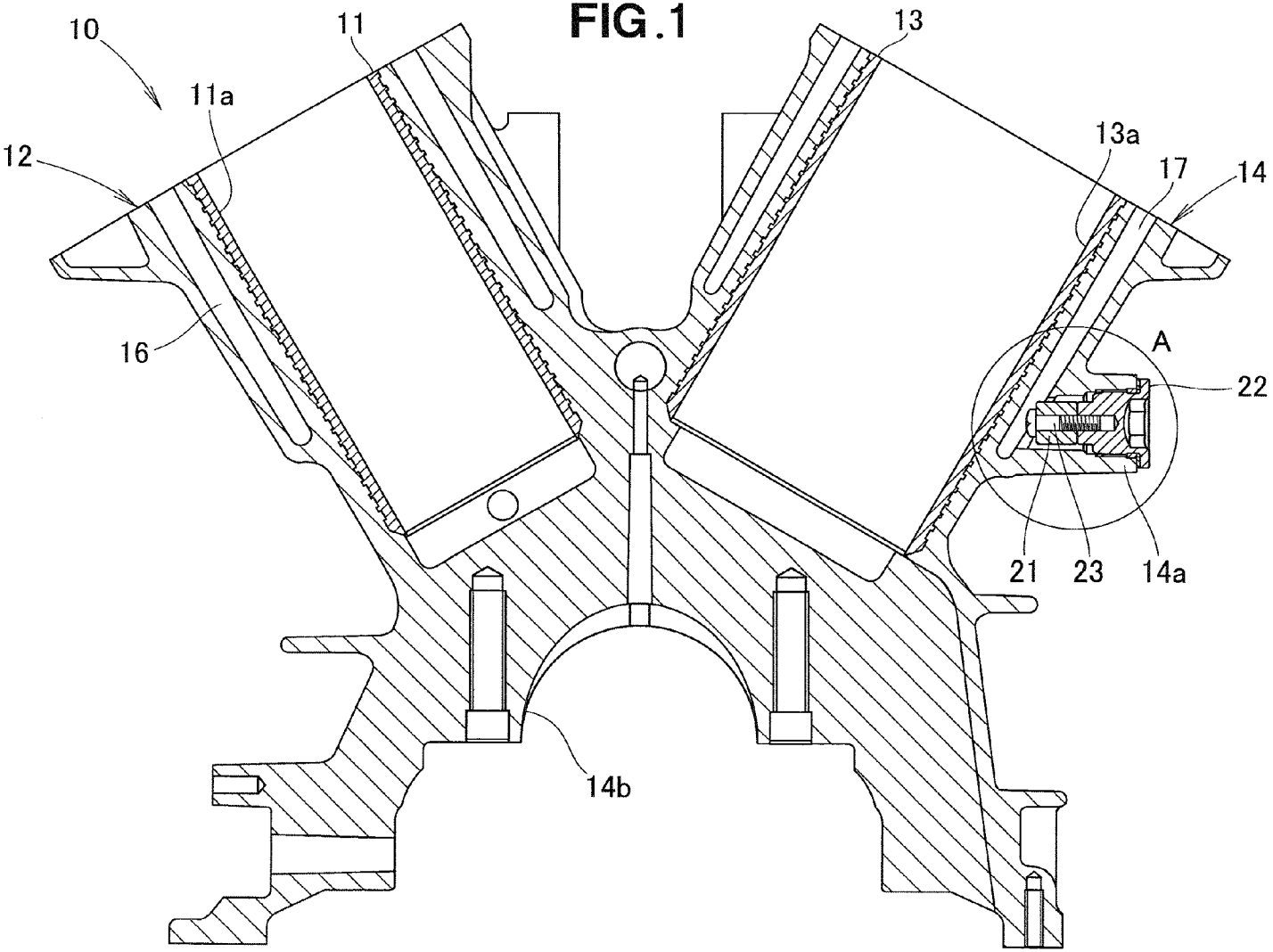
FIG. 1 is a sectional view of an engine cylinder block employing an embodiment of a sacrificial electrode mounting structure of the present invention.

Reference is now made to FIG. 1 showing in section a cylinder block employing an embodiment of a sacrificial electrode mounting structure of the present invention. The cylinder block 10 is of a water-cooled V-type engine provided in an outboard engine unit and includes a first cylinder section 12 having a cylinder liner 11 embedded therein and a second cylinder section 14 having a cylinder liner 13 embedded therein. Respective axis lines of cylinder holes 11*a* and 13*a* of the cylinder liners 11 and 13 are disposed in a V shape configuration. A first water jacket 16 is formed in the first cylinder section 12 in such a manner as to surround the cylinder liner 11 while a second water jacket 17 is formed in the second cylinder section 14 in such a manner as to surround the cylinder liner 13, and these first and second water jackets 16 and 17, each functioning as a cooling water passageway, are in communication with each other.

A mounting port 14*a*, where an anode metal member 21 functioning as a sacrificial electrode is disposed, is provided on a side of the second cylinder section 14 adjacent to the second water jacket 17 and having a mounting through-hole that opens outwardly from the second water jacket 17. The mounting hole of the mounting port 14*a* is closed at its outer end (remote from the second water jacket 17) with a lid member 22, and the anode metal member 21 is fixedly fastened, via a threaded sacrificial electrode mounting fastener member (screw in the illustrated embodiment) 23, to the distal end (inner end) of the lid member 22. Reference numeral 14*b* indicates a main bearing section that supports a crankshaft.

Figure 2:
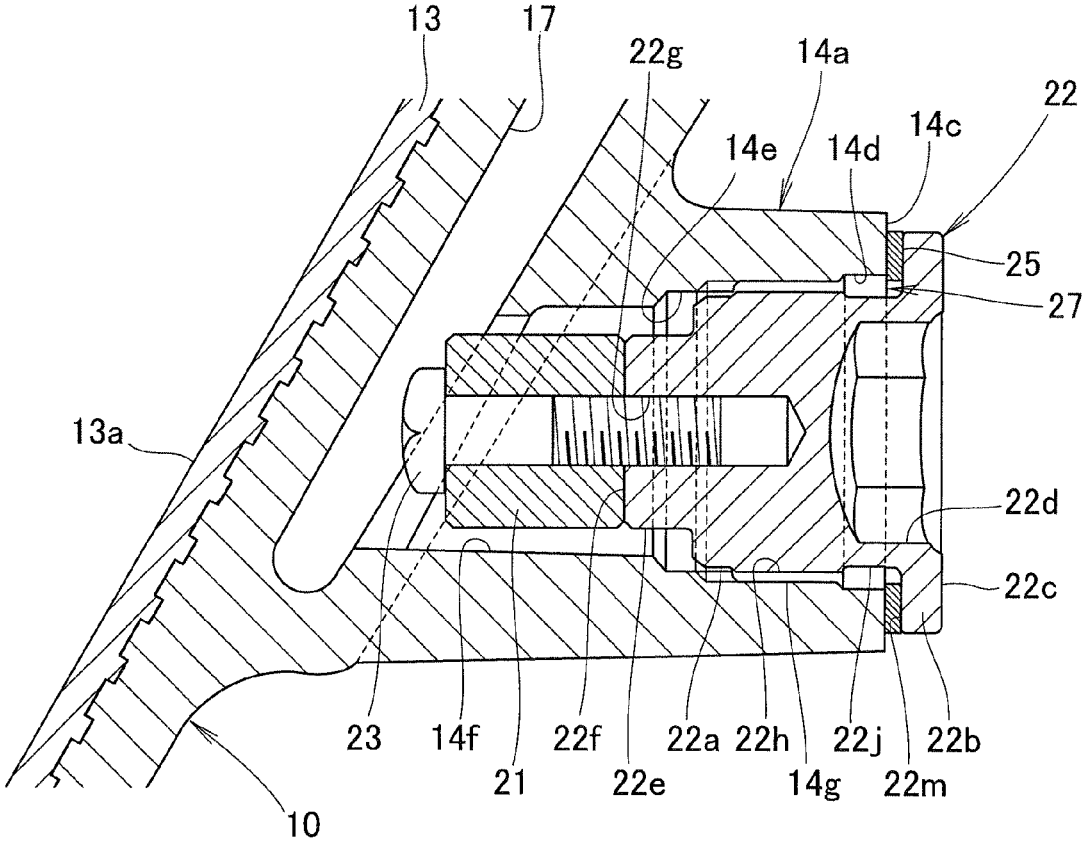
FIG. 2 is an enlarged view of a section encircled at A in FIG. 1.

FIG. 2 is an enlarged sectional view of a section encircled at A in FIG. 1. The mounting hole of the mounting port 14*a* comprises: a large-diameter hole 14*d* formed in an outer end portion 14*c* of the port 14*a* (i.e., hole 14*d* formed as an annular recessed portion in the inner peripheral surface of the outer end portion of the mounting port 14*a*); a threaded middle hole 14*e* formed integrally with the bottom (i.e., inner end) of the large-diameter hole 14*d*; a communicating hole 14*f* formed integrally with the bottom of the threaded middle hole 14*e*; and an internal thread (i.e., internally threaded portion) 14*g* formed in a region of the threaded middle hole 14*e* adjacent to the large-diameter hole 14*d*. The communicating hole 14*f* allows the large-diameter hole 14*d* and the second water jacket 17 to communicate with each other via the threaded middle hole 14*e*.

As further shown in FIG. 2, the lid member 22 includes: a shaft portion 22*a* provided on a longitudinally middle region of the lid member 22; a flange (or head) portion 22*b* formed at one (i.e., outer) end of the shaft portion 22*a*; a hexagonal hole 22*d* formed in the outer end surface 22*c* of the flange portion 22*b*; a protruding portion 22*e* formed at the other end of the shaft portion 22*a*; an internal thread 22*g* formed in an inner end surface portion 22*f* of the protruding portion 22*e*; an external thread (or externally threaded portion) 22*h* formed on the shaft portion 22*a* to extend inwardly from near the flange (or head) portion 22*b*; and an annular recessed portion 22*j* formed in a region of the shaft portion 22*a* adjacent to the flange portion 22*b*, i.e. in an outer end portion of the lid member 22 between the head portion 22*b* and the externally threaded portion 22*h*, for a purpose to be set forth later.

The externally threaded portion 22*h* of the lid member 22 engages with the internally threaded portion 14*g* of the mounting port 14*a*, and the flange portion 22*b* of the lid member 22 has an inner or seating surface 22*m* abutted against the outer end surface of the outer end portion 14*c* of the mounting port 14*a* via a washer 25. An annular space 27 is defined by the large-diameter hole 14*d* formed in the outer end portion 14*c* of the mounting port 14*a* and the annular recessed portion 22*j* of the lid member 22.

Further, a sealing member (sealing tape in the illustrated embodiment) 28 (FIG. 3) is sandwiched between the internally threaded portion 14*g* of the mounting port 14*a* and the externally threaded portion 22*h* of the lid member 22 in such a manner that part of the sealing tape 28 protruding outside from between the internally threaded portion 14*g* and the externally threaded portion 22*h* engaging with each other can be received in the above-mentioned annular space 27.

Figure 3:
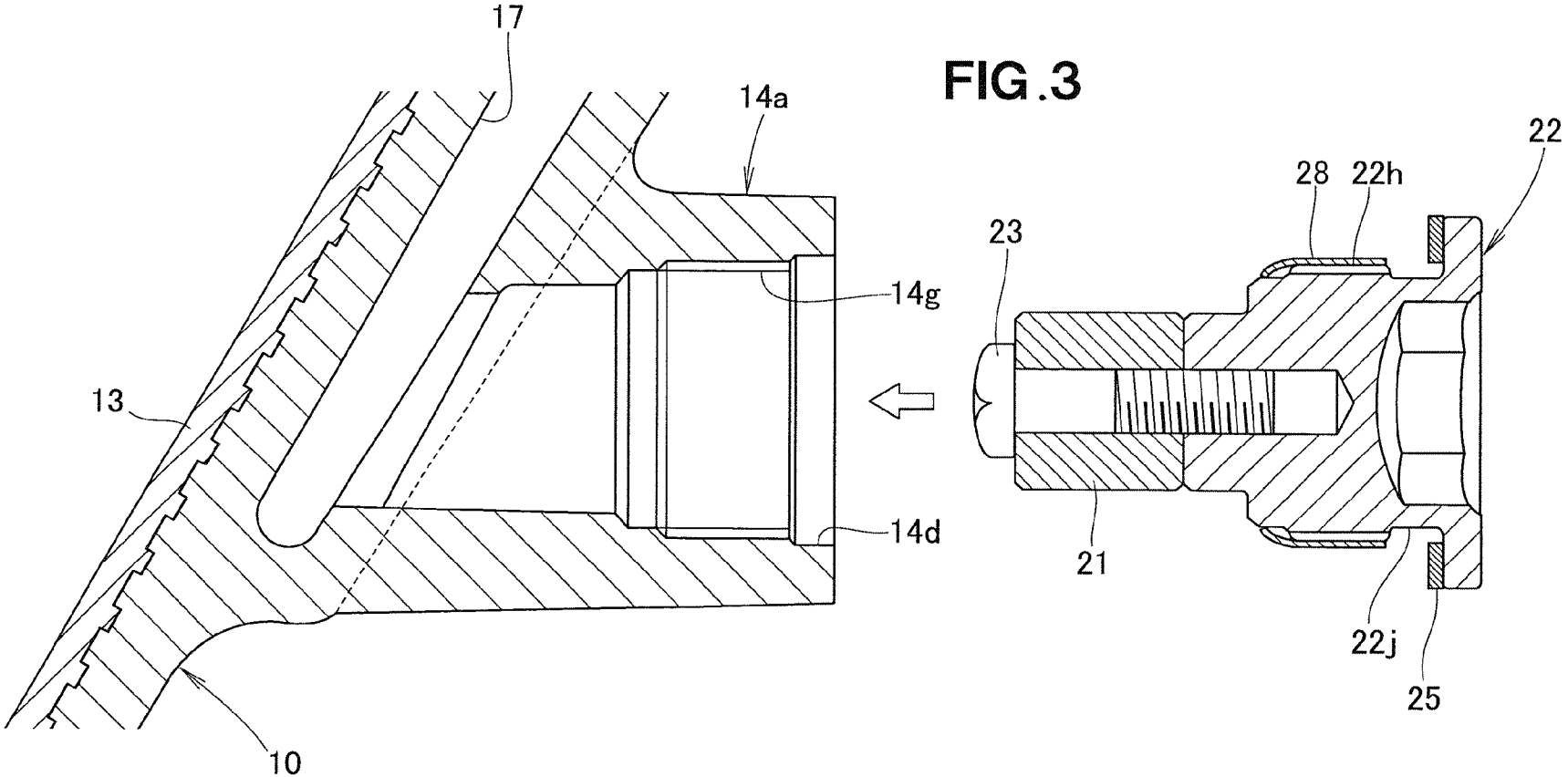
FIG. 3 is a sectional view of the embodiment of sacrificial electrode mounting structure of the present invention.
Figure 4:
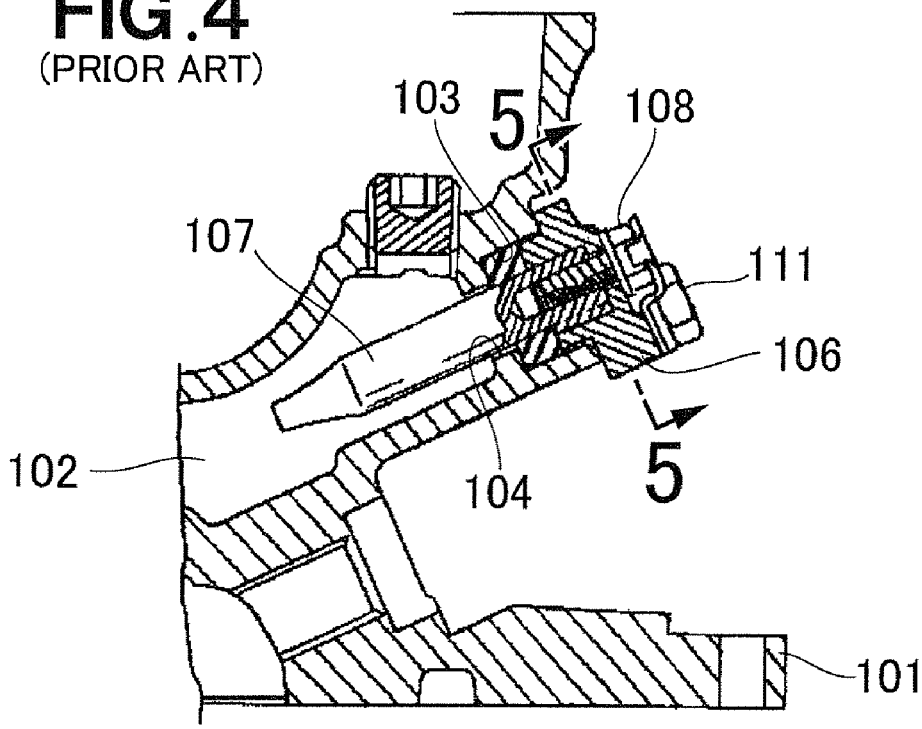
FIG.4 (PRIOR ART)
FIG. 4 is a sectional view showing a conventionally-known sacrificial electrode mounting structure.
Figure 5:
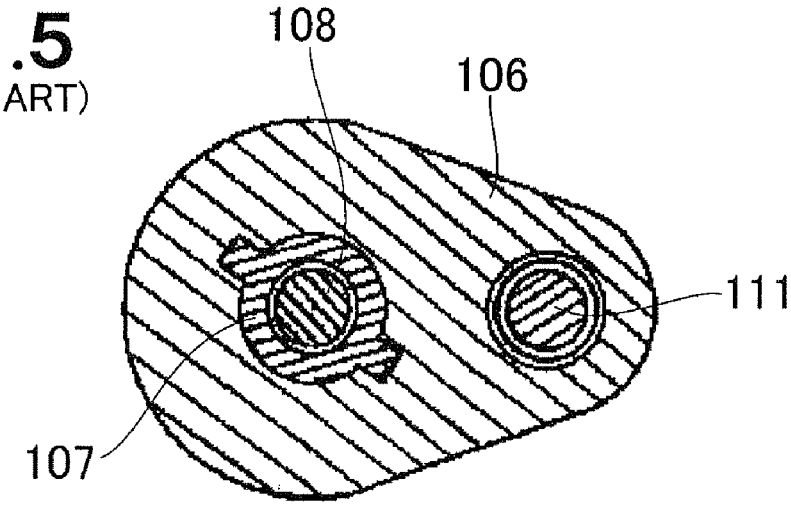
FIG.5 (PRIOR ART)
FIG. 5 is a sectional view taken along line 5-5 of FIG. 4.
Figure 6:
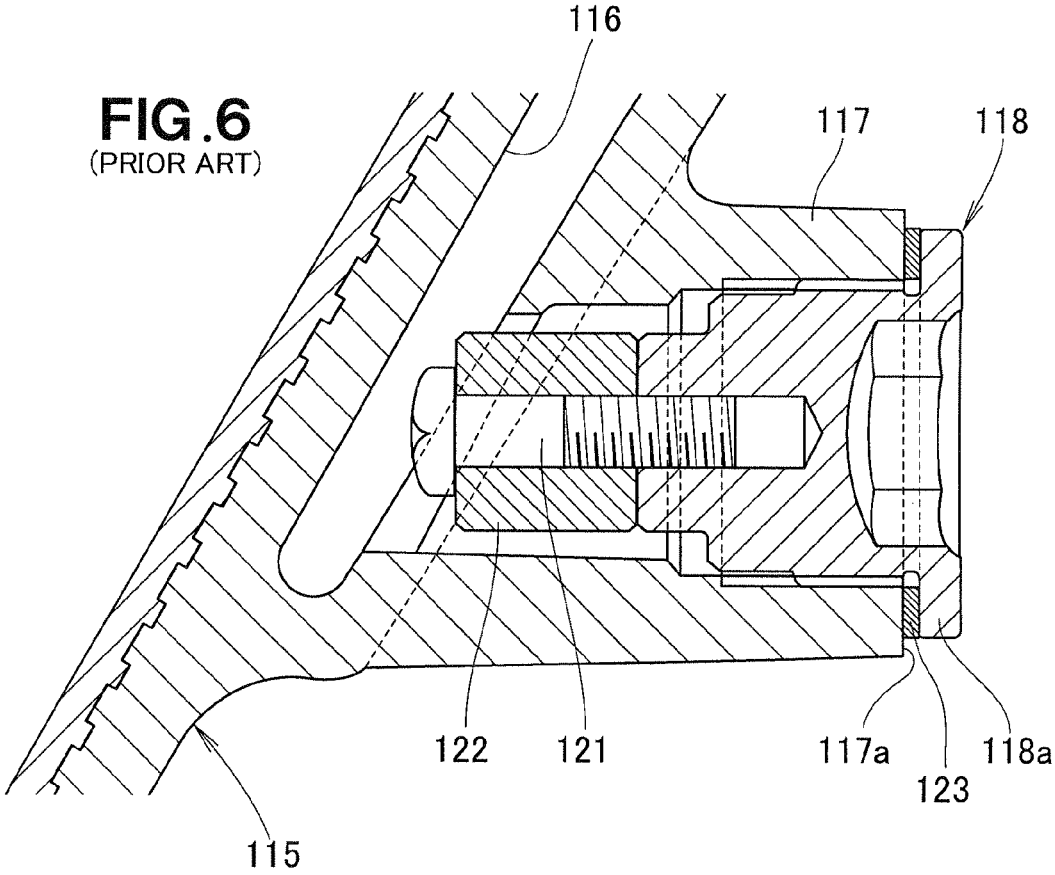
FIG.6 (PRIOR ART)
FIG. 6 is a sectional view showing another conventionally-known sacrificial electrode mounting structure.

The following describe how the lid member 22 is attached to the mounting port 14*a*, with reference to FIG. 3 that is a sectional view of the sacrificial electrode mounting structure of the present invention.

As shown in FIG. 3, the sealing tape 28 is wound on the externally threaded portion 22*h* of the lid member 22 with the anode metal member 21 fixedly fastened in advance to the distal end portion of the lid member 22 by means of the screw 23 screwed to the internal thread 22*g* formed in the inner end surface portion 22*f* of the protruding portion 22*e*, and then the externally threaded portion 22*h* of the lid member 22 is screwed to the internally threaded portion 14*g* of the mounting port 14*a*.

Thus, the sealing tape 28 seals between the externally threaded portion 22*h* of the lid member 22 and the internally threaded portion 14*g* of the mounting port 14*a*, and part of the sealing tape 28 protruding from between the externally threaded portion 22*h* and the internally threaded portion 14*g* at the time of the screwing can be received in the annular space 27.

The instant embodiment arranged in the aforementioned manner can reliably prevent the sealing tape 28 from undesirably getting into (i.e., being sandwiched) between the flange portion 22*b* of the lid member 22 and the washer 25 or between the washer 25 and the mounting port 14*a*. Thus, the instant embodiment can reduce electrical resistance between the mounting port 14*a* and the lid member 22 and hence between the cylinder block 10 and the anode metal member 21, thereby effectively promoting corrosion of the anode metal member 21.

Namely, according to the present invention, as shown in FIGS. 1 and 2, the sacrificial electrode mounting structure is designed for mounting the anode metal member 21, functioning as the sacrificial electrode, in the second water jacket 17 that is a cooling water passageway provided in the cylinder block 10 of the water-cooled engine 14 of the outboard engine unit. The mounting port 14*a* for mounting the anode metal member 21 is provided adjacent to the second water jacket 17, and the anode metal member 21 is fixedly fastened to the lid member 22 having the externally threaded portion 22*h* screwed to the mounting port 14*a*. With the lid member 22, having the anode metal member 21 fixedly fastened thereto, inserted in the mounting hole of the mounting port 14*a* and duly attached to the mounting port 14*a* with the externally threaded portion 22*h* and the internally threaded portion 14*g* engaging with each other with the sealing tape 28 sandwiched therebetween, the space 27 is defined between the outer end portion of the mounting port 14*a* located outwardly of the internally threaded portion 14*g* and the outer end portion of the lid member 22. Thus, the present invention not only allows the anode metal member 21 to be easily replaced as necessary by merely removing the lid member 22 from the mounting port 14*a*, but also can reliably prevent contact failure between the mounting port 14*a* and the lid member 22 which would occur due to the provision of the sealing tape (sealing member) 28 provided on the externally threaded portion 22*h* and can promote corrosion of the anode metal member 21 by securing a good electrical connection between the anode metal member 21 and the mounting port 14*a*.

Note that the space 27 may be defined by at least one of the annular recessed portion 22*j* formed in the outer end portion of the lid member 22 and the large-diameter hole 14*d* formed in the outer end portion of the mounting port 14*a*.

Because the space 27 can be defined by the annular recessed portion 22*j* formed in the outer peripheral surface of the lid member 22 adjacent to the inner surface of the head portion (lid member's flange portion) 22*b*, i.e. between the head portion 22*b* and the externally threaded portion 22*h*, the space 27 can be formed easily by merely forming the annular recessed portion 22*j* in the lid member 22.

Also, because the space 27 can be defined by the large-diameter hole 14*d* formed as the annular recessed portion in the inner peripheral surface of the outer end portion of the mounting port 14*a*, the present invention can minimize the number of necessary steps for making a setup change of a device employed for forming the mounting port 14*a*, by forming the large-diameter hole 14*d* as well at the time of the formation of the mounting port 14*a*.

The sacrificial electrode mounting structure of the present invention is well suited for application to outboard engine units.

What is claimed is:

1. A sacrificial electrode mounting structure for mounting a sacrificial electrode in a cooling water passageway provided in a cylinder block of a water-cooled engine of an outboard engine unit, comprising:

a mounting port provided adjacent to the cooling water passageway and having a mounting hole that opens outwardly from the cooling water passageway for mounting the sacrificial electrode in the cooling water passageway; and a lid member closing an outer end of the hole remote from the cooling water passageway, the lid member having a head portion formed at an outer end thereof and an externally threaded portion, the lid member having the sacrificial electrode fixedly fastened thereto being inserted in the hole and attached to the mounting port with the externally threaded portion engaging with an internally threaded portion formed in the hole of the mounting port with a sealing member sandwiched therebetween, wherein, with the lid member fixedly attached to the mounting port, a space is defined between an outer end portion of the mounting port located outwardly of the internally threaded portion and an outer end portion of the lid member between the externally threaded portion and the head portion, so that part of the sealing member protruding from between the externally threaded portion and the internally threaded portion engaging with each other is received in the space.

2. The sacrificial electrode mounting structure of claim 1, wherein the space is defined by at least one of a recessed portion formed in the outer end portion of the lid member between the head portion and the externally threaded portion and a recessed portion formed in an inner peripheral surface of the outer end portion of the mounting port.

* * * * *